United States Patent [19]

Cooprider et al.

[11] 3,987,938

[45] Oct. 26, 1976

[54] DISPENSING PUMP

[75] Inventors: Rex C. Cooprider, Hacienda Heights; Richard P. Grogan, San Bernadino; Michael G. Knickerbocker, Long Beach, all of Calif.

[73] Assignee: Diamond International Corporation, New York, N.Y.

[22] Filed: Sept. 18, 1975

[21] Appl. No.: 614,659

[52] U.S. Cl. ..... 222/209; 222/213; 417/479; 222/211

[51] Int. Cl.[2] ..... B65D 37/00

[58] Field of Search ..... 222/206, 207, 211–214, 222/386.5, 383, 204, 401; 417/437, 479

[56] References Cited

UNITED STATES PATENTS

| | | | |
|---|---|---|---|
| 3,160,329 | 12/1964 | Radic et al. | 222/211 |
| 3,753,518 | 8/1973 | Kutik | 222/383 |
| 3,785,532 | 1/1974 | Cooprider | 222/207 |
| 3,910,458 | 10/1975 | Ewald | 222/383 |

*Primary Examiner*—Robert B. Reeves
*Assistant Examiner*—H. Grant Skaggs
*Attorney, Agent, or Firm*—Watson, Cole, Grindle & Watson

[57] ABSTRACT

A dispensing pump for application to a product container includes an elongated housing having a recess in a sidewall thereof and a flexible bulbous diaphragm seated over the recess for a trigger-type actuation as the housing is gripped in the manner of a handle. A variable volume pump chamber is defined by the diaphragm together with the recess, and an inlet passage is provided in the housing through which the product passes from the container into the recess. The diaphragm has an annular inner skirt for closing the inlet passage in response to axial deformation of the diaphragm, as well as intermediate and outer annular skirts. The intermediate skirt has a lower free edge portion normally covering a discharge port in the housing which communicates with the pump housing, and the outer skirt has a lower free edge portion normally covering a vent port in the housing which communicates with the atmosphere. The lower edge portions of the intermediate and outer skirts are of resilient flexible materials so as to respectively uncover the discharge and vent ports in response to a given fluid pressure therewithin. Accordingly, the inlet passage is closed upon depression of the diaphragm and the discharge passage is simultaneously uncovered to permit the contents of the diaphragm to be discharged. Upon release of the diaphragm the vacuum pressure thereby created effects a closing of the discharge passage and an opening of the inlet passage for refilling of the pump chamber. As the dispensable product is withdrawn from the container, the vacuum pressure therein created effects an opening of the vent passage and permits air to flow into the container.

13 Claims, 5 Drawing Figures

FIG. 1
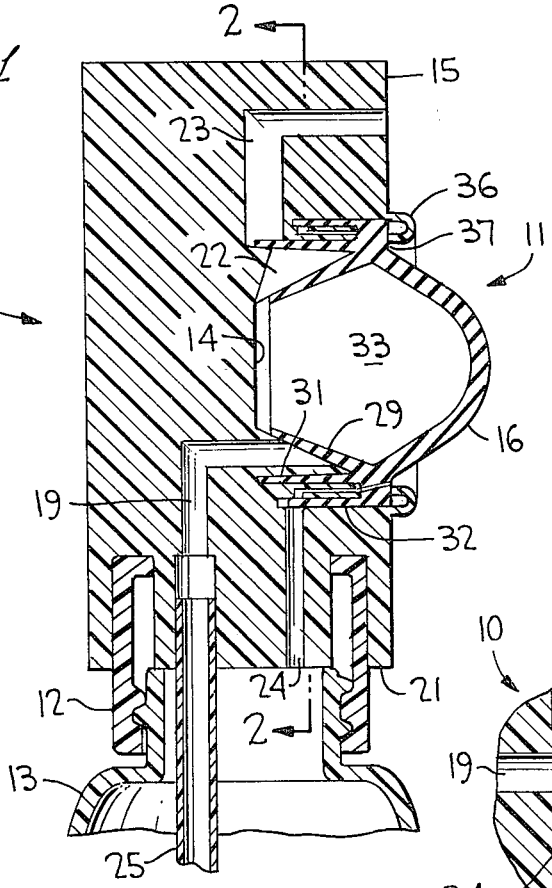
FIG. 2
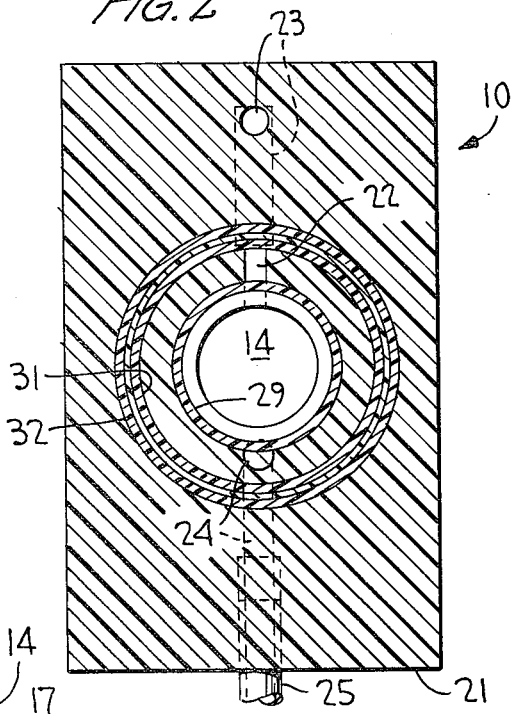
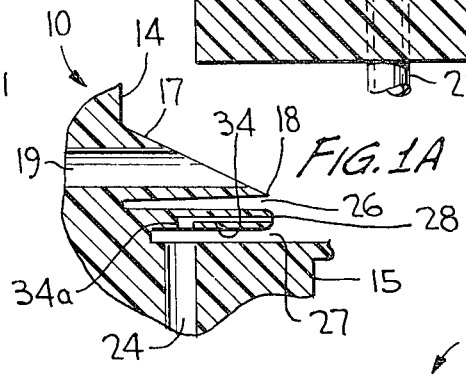
FIG. 1A
FIG. 3
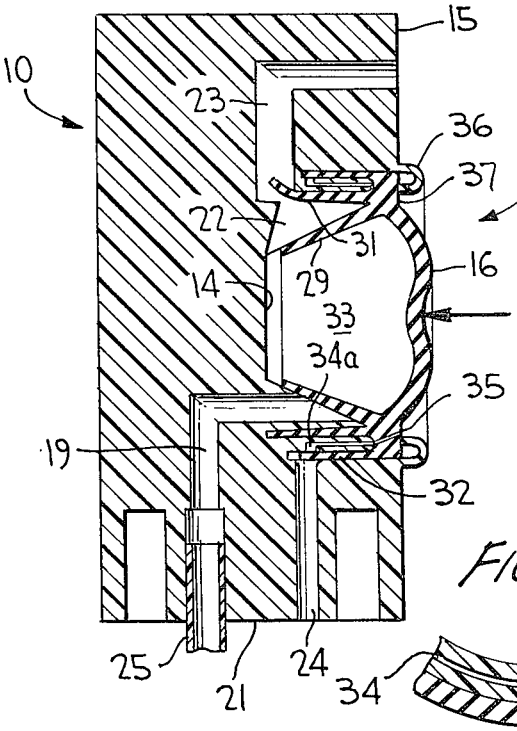
FIG. 4
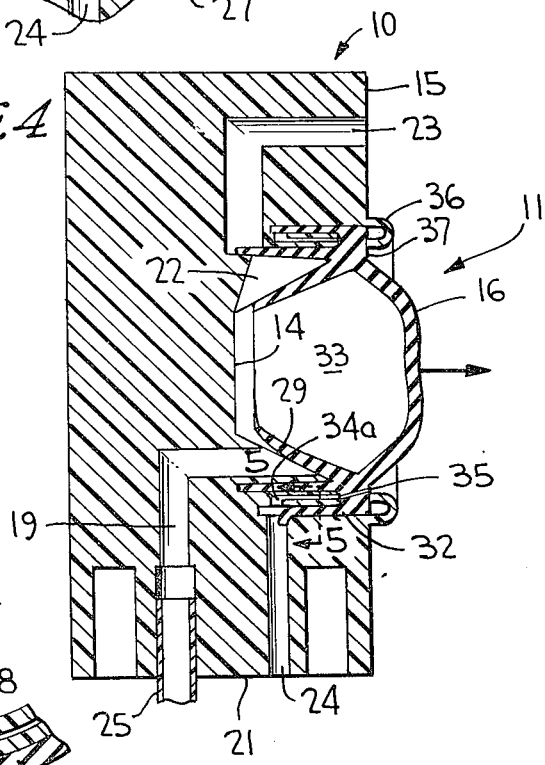
FIG. 5
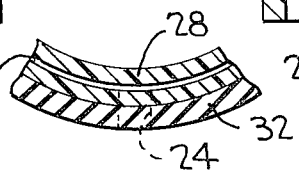

DISPENSING PUMP

BACKGROUND OF THE INVENTION

This invention relates generally to a dispensing pump wherein the pumping action is effected through deformation of a resiliently flexible bulbous diaphragm. More particularly, the diaphragm is provided with annular skirts for simultaneously opening and covering discharge and inlet ports upon deformation of the diaphragm, and for opening and covering a vent port in response to a given fluid pressure within the vent port.

U.S. Pat. No. 3,785,532, dated Jan. 15, 1974 and commonly owned herewith, discloses a dispensing pump of the press bulb type having inlet and discharge valves for respectively controlling the closing and opening of inlet and discharge passages upon axial deformation of a bulbous diaphragm. As is typical for this type of dispensing pump, as well as for dispensing pumps disclosed in U.S. Pat. Nos. 2,815,890, 2,853,210, and 3,102,489, after the pump chamber is filled with the product to be dispensed, the product is discharged from and subsequently refills the chamber each time the diaphragm is depressed and released. Further disclosed in U.S. Pat. No. 3,785,532 is a vent for the container which communicates with the atmosphere when dispensing the product. However, in order to dispense the product, a discharge spout and an outer member must be relatively rotated so as to bring discharge port segments of the outer member and an inner member into registry. A groove and a vent are likewise placed in communication with one another during such relative rotation so as to permit the venting of air from the atmosphere into the container interior during the dispensing operation.

Despite the advantages over the prior art arrangements with the use of the dispensing pump set forth in U.S. Pat. No. 3,785,532, relative rotation of parts thereof is required prior to dispensing for the purpose of not only registering discharge port segments but also for registering vent port segments necessary for the dispensing operation. Therefore, the number of parts required to be formed and assembled in carrying out such an operation results in a more costly and complex dispensing pump arrangement.

SUMMARY OF THE INVENTION

It is therefore an object of the present invention to provide an improved dispensing pump having an absolutely minimum number of parts and being so arranged for easy production and assembly of the parts so as to produce a dispensing pump which can be operated more efficiently and manufactured more easily and economically.

Another object is to provide such a dispensing pump as having a flexible bulbous diaphragm with annular skirts thereon for effectively controlling inlet, discharge and vent ports upon deformation of the diaphragm during the dispensing operation.

A further object is to provide such a dispensing pump wherein the diaphragm with its annular skirts avoids the need for any specific registry or port segments during both assembly of the pump and prior to the dispensing operation.

A still further object of this invention is to provide such a dispensing pump wherein the skirts are so disposed relative to their respective ports that an inner one of the skirts closes an inlet passage as the diaphragm is deformed, an intermediate one of the skirts normally closes the discharge port and is deflectable to uncover such port in response to increased fluid pressure within the pump chamber, and an outer one of the skirts normally closes the vent port but is deflectable to open such port in response to decreased fluid pressure within a vent passage.

Other objects, advantages and novel features of the invention will become more apparent from the following detailed description of the invention when taken in conjunction with the accompanying drawings.

BRIEF DESCRIPTION OF THE DRAWINGS

FIG. 1 is a vertical sectional view taken through a dispensing pump in accordance with the present invention;

FIG. 1A is slightly enlarged partial view of the pump housing without the diaphragm;

FIG. 2 is a sectional view of the pump taken substantially along line 2—2 of FIG. 1;

FIGS. 3 and 4 are sectional views similar to FIG. 1 but showing the operation of the skirt vents during deflection of the diaphragm; and FIG. 5 is a slightly enlarged plan view section of an annular vent groove provided in the housing.

DESCRIPTION OF THE PREFERRED EMBODIMENT

Turning now to the drawings wherein like reference characters refer to like and corresponding parts throughout the several views, the pump structure of the invention generally comprises a pump housing 10 and an elastic resiliently flexible bulbous diaphragm 11. A cylindrical sleeve or cap 12 is either fixedly or rotatably secured to the housing for operatively supporting the pump structure on a conventional product container such as a bottle, jar or can as the internally threaded cap 12 is threaded onto the neck or dispensing opening of container 13. Both the housing and the cap are adapted for formation from a suitable resilient plastic material such as linear polyethylene.

The housing is generally of an elongated configuration shown in the drawings and may be circular or polygonal in horizontal cross-section so that the housing may be gripped by a hand of the operator and as in the manner of a pistol handle. Also, a recess 14 is provided in a side wall 15 of the housing, and diaphragm 11 is seated over this recess in such a manner that its crown portion 16 protrudes outwardly of the side wall. Therefore, the diaphragm may be depressed inwardly of the recess by a finger of the operator's hand which simply overlies the diaphragm as he grips the handle for trigger-like actuation thereof.

Recess 14 has a conical wall 17 sloping inwardly of its bottom flat wall toward the central axis of the recess. As shown more clearly in FIG. 1A the larger end of this conical wall terminates at an edge 18 lying inwardly of sidewall 15 of the housing.

An inlet passage 19 is formed in the housing and extends from an inner endwall 21 of the housing and is bent at 90° intersecting with conical wall 17 of the recess. A discharge port 22 likewise intersects with conical wall 17 between the bottom wall and the outer end of the recess. A discharge passage 23 is also formed in the housing so as to communicate with its discharge port and to open into the atmosphere through sidewall 15. The housing further contains a vent passage 24 extending toward the diaphragm from end wall 21 for the purpose for venting the interior of the container to the atmosphere in a manner to be hereinafter described. A dip tube 25 is secured in place within the inlet passage so as to extend this passage toward the bottom wall of the container in the normal manner.

As shown in the drawings and especially in FIG. 1A, the housing is provided with concentric annular recesses 26 and 27 defining an annular projection 28 therebetween.

Diaphragm 11 is provided with integral annular skirts 29, 31 and 32 extending inwardly of the housing. Inner skirt 29 lies against conical wall 17 of the recess, while intermediate skirt 31 and outer skirt 32 are seated sealingly within annular recesses 26 and 27, respectively. The diaphragm therefore forms together with recess 14 a pump chamber 33, the volume of which may be readily varied by deformation of crown portion 16 of the diaphragm, preferably by inward finger pressure exerted thereagainst.

The diaphragm including its skirts 29, 31 and 32 is of a material such as natural or artificial rubber which has sufficient flexibility and elasticity so as to be resiliently deflectable. Thus, annular skirt 29 normally covers inlet passage 19 at its opening into pump chamber 33 during the depression stroke of the diaphragm (FIG. 3) when the pump chamber is filled with fluid. During the release stroke of the diaphragm as shown in FIG. 4, skirt 29 is sufficiently flexible to move inwardly of the recess to uncover the inlet passage in response to the vacuum pressure created in the pump chamber during refilling. The lower end portion of intermediate skirt 31 extends sufficiently inwardly of the pump housing so as to normally close discharge port 22. This lower end portion is sufficiently flexible, however, as to deflect outwardly as shown in FIG. 3 to uncover the discharge port in response to increased fluid pressure within pump chamber 33 as during inward deflection of the diaphragm.

For the purpose of venting the interior of the container to the atmosphere during the dispensing operation, an annular vent port 34 is provided in annular projection 28 as shown in FIG. 5. This vent port has a vent seat **34*a* communicating with passage 24, and opens at the free end of projection 28 as shown in FIG. 1A. A through opening 35 is provided in the diaphragm so as to connect port 34 with the atmosphere. Also, it can be seen that the lower edge portion of skirt 32 extends into annular recess 27 sufficiently to fully cover vent seat 34*a* without completely overlapping vent passage 24. Accordingly, this flexible end portion will deflect outwardly away from seat 34*a* as shown in FIG. 4** in response to a decrease of fluid pressure within the vent passage as during a refilling of the pump chamber after its contents have been dispensed.

The housing is also provided with an annular flange adjacent outer skirt 32 for the purpose of anchoring the diaphragm in place after this flange has been swaged over a portion of annular shoulder 37 of the diaphragm which lies substantially flush with side wall 15.

In assembling what is essentially a two part dispensing pump, diaphragm 11 is seated over recess 14 of the pump housing so that its three annular skirts are disposed as aforedescribed. Flange 36 is then swaged over shoulder 37 of the diaphragm to anchor it securely in place. The inlet, discharge and vent valves thus constituted by skirts 29, 31 and 32, respectively, require no particular angular orientation with respect to housing 10 since these valves are operative in all positions of rotative orientation on the housing. Also, since vent port 34 is annular, communication with opening 35 is assured for any rotative orientation of the diaphragm respecting the housing.

In order to dispense the product, the diaphragm is depressed inwardly at its crown portion so that any air trapped in pump chamber 33 is correspondingly pressurized so as to open the discharge valve defined by skirt 31 to be released through port 22 and discharge passage 23. As the diaphragm is so depressed, the internal pressure within the chamber likewise forces skirt 29 outwardly so as to cover inlet passage 19. As the finger pressure is released and crown portion 16 of the diaphragm is permitted to re-expand to its normal volume as shown in FIG. 1, the vacuum created within the pump chamber 33 causes skirt 31 to be pulled tightly against the discharge port and at the same time forces skirt 29 inwardly away from the inlet passage to thereby draw the flowable product upwardly through dip tube 25. After one or more depressions of the diaphragm the product is drawn into the pump chamber for substantially filling same.

After the product is received within pump chamber 33, each inward depression of the flexible diaphragm toward the pump chamber will force the product outwardly therefrom and through discharge port 22 with sufficient pressure to open discharge valve 31 so that the product may flow beneath the lower edge of that valve as shown in FIG. 3 and thereafter outwardly through discharge passage 23. Of course, the pump may be actuated by intermittent pressure on the flexible diaphragm to dispense as much of the product as is desired.

Upon release of the diaphragm the inlet valve constituted by inner skirt 29 is moved inwardly of the pump chamber as aforedescribed by means of the vacuum created within the pump chamber as its volume returns to its initial position. The discharge valve constituted by intermediate skirt 31 is accordingly drawn inwardly against the discharge port for covering same, the interior of the container is vented to atmosphere as the product is filling the pump chamber. While the diaphragm crown portion is being depressed inwardly, opening 35 in the diaphragm is slightly stretched so as to assure open communication between the vent port and the atmosphere. Such venting is therefore effected by the vacuum pressure created in the container during the refilling operation, the vacuum pressure causing a lower portion of skirt 32 to be drawn outwardly away from seat **34*a* of the vent port (see FIG. 4). Thus, as the lower edge portion of skirt 32 is pulled outwardly away from the vent seat, distortion of the diaphragm crown portion maintains opening 35 open so as to permit air to be vented therethrough, into the vent port, through the vent passage and into the interior of the container as necessary to replace the product withdrawn therefrom by the pump. And, by the time the diaphragm returns to its initial position of FIG. 1, the pump chamber will be refilled with the product, opening 35 will be closed because of the constriction thereof caused by a crown portion, and vent seat 34*a* will be closed by the lower end portion of skirt 32**.

From the foregoing it can be seen that only a minimum number of parts is required for the present dispensing pump, and that no particular angular orientation of the diaphragm is required relative to the housing. Also, no registry between elements of the pump is required prior to dispensing.

Obviously, many modifications and variations of the present invention are made possible in the light of the above teachings. It is therefore to be understood that within the scope of the appended claims the invention may be practiced otherwise than as specifically described.

What is claimed is:

1. A product dispensing pump for application to a container, comprising a housing having a recess therein, a flexible bulbous diaphragm seated within said recess in fluidtight relationship, said diaphragm defining a variable volume pump chamber together with said recess, vent means in said housing and in said diaphragm for venting the interior of the container to the atmosphere, a discharge port in said housing extending outwardly of said recess, and an inlet passage in said housing extending into said recess from an inner end thereof which fluid is inletted from the container, said diaphragm having first, second and third annular skirt elements so disposed that, upon depression of said diaphragm during a fluid-filled condition of said pump chamber, portions of said first and second skirt elements are forced radially outwardly to respectively close and open said inlet passage and discharge port for discharging the fluid contents out of said pump chamber and, upon release of said diaphragm, said portions of said first and second skirt elements are forced radially inwardly to respectively open and close said inlet passage and discharge port for allowing said pump chamber to refill with fluid, a portion of said third skirt element being forced radially outwardly during the release of said diaphragm to open said vent means thereby venting the container to the atmosphere.

2. The product dispensing pump according to claim 1, wherein said recess is defined by a conical wall sloping toward the central axis of said diaphragm from said outer surface of said housing, said skirt elements being substantially concentric and said first skirt element lying against said conical wall and said inlet passage which intersects with said conical wall.

3. The product dispensing pump according to claim 2, wherein said discharge passage port intersects with said conical wall, a discharge passage in said housing communicating with said discharge port through which fluid is discharged through said housing, and said second skirt element lies outwardly of said first skirt element and extends into said discharge passage for closing and opening same.

4. The product dispensing pump according to claim 3, wherein said third skirt element lies outwardly of said second skirt element, said vent means including a vent passage and a vent port communicating with one another as well as with a vent opening in said diaphragm, said third skirt element normally closing said vent port and opening same during the release of said diaphragm.

5. The product dispensing pump according to claim 1, wherein said housing is elongated along a direction perpendicular to said central axis of said diaphragm thereby forming a handle grip facilitating a trigger depression and release of said diaphragm, said recess lying in said outer surface of said housing, and said discharge passage intersecting with said outer surface.

6. A dispensing pump, comprising an elongated housing forming a handle grip, said housing having inlet and vent passages therein, a recess located in a side wall of said housing, a resiliently deformable diaphragm seated over said recess and defining a variable volume pump chamber therewith, said inlet passage extending between an end wall of said housing and opening into said recess, a discharge port extending outwardly of said recess, said diaphragm having an inlet valve in the form of a first annular skirt for closing said inlet passage as said diaphragm is deformed, a discharge valve in the form of a second annular skirt on said diaphragm, said second annular skirt normally closing said discharge port and being deflectible to uncover said discharge port in response to increased fluid pressure within said pump chamber, a vent port in said housing communicating with an outwardly extending opening in said diaphragm, said vent passage extending between said end wall of said housing and communicating with said vent port, and a vent valve on said diaphragm in the form of third annular skirt which normally closes said vent port but is deflectible to open said vent port in response to decreased fluid pressure within said vent passage.

7. The dispensing pump according to claim 6, wherein said recess is defined by a conical wall sloping toward the central axis of said diaphragm from said side wall of said housing, and wherein said inlet passage extending into said recess lies between said first and second skirts.

8. The dispensing pump according to claim 6, wherein said housing has a first annular recess surrounding said conical wall and sealingly receives said second skirt, said discharge port communicating with said first annular recess in an outwardly deflected position of said second skirt, and said housing has a discharge passage therein extending between said side wall and communicating with said first annular recess.

9. The dispensing pump according to claim 6, wherein said housing has a second annular recess surrounding said first annular recess and sealingly receives said third skirt, said vent port communicating with said second annular recess in an outwardly deflected position of said third skirt.

10. The dispensing pump according to claim 6, wherein said diaphragm has a crown portion surrounded by an annular shoulder, and said housing has a flange thereon adjacent said shoulder and in engagement therewith for retaining said diaphragm in place.

11. A dispensing pump for application to a product container, comprising an elongated housing having a recess in a side wall thereof and a resiliently flexible bulbous diaphragm seated over said recess for actuation in the manner of a trigger as said housing is gripped like a handle, said diaphragm defining together with said recess a pump chamber the volume of which may be varied by deformation of said diaphragm, means at one end of said housing defining an inlet passage opening into said recess, an annular inner skirt on said diaphragm within said pump chamber for closing said inlet passage in response to axial deformation of said diaphragm, concentric annular recesses in said housing opening into said side wall, annular intermediate and outer skirts on said diaphragm respectively engaged in said annular recesses, said intermediate skirt having a lower free edge portion normally covering a discharge port in said housing which communicates with said pump housing, said outer skirt having a lower free edge portion normally covering a vent port in said housing which communicates with the atmosphere through an opening provided in said diaphragm and which communicates with a vent passage opening into said one end of said housing, said lower edge portion of said intermediate skirt being of resilient flexible material so as to uncover said discharge port in response to a given fluid pressure within said discharge port, and said lower edge portion of said outer skirt being of resilient flexible material so as to uncover said vent port in response to a given fluid pressure within said passage vent.

12. The dispensing pump according to claim 11, wherein said housing has a discharge passage establishing communication between said discharge port and the atmosphere.

13. The dispensing pump according to claim 11, wherein said means at said one end of said housing includes a dip tube for extending into the interior of the container.

* * * * *